US012612218B2

(12) United States Patent
Piccioni

(10) Patent No.: US 12,612,218 B2
(45) Date of Patent: Apr. 28, 2026

(54) COVER OR CAP SCREWABLE ONTO A CONTAINER, IN PARTICULAR OF GLASS, WITH A MANUAL GRIP FORMED BY A RECESS OR A BAR

(71) Applicant: VETRERIA DI BORGONOVO SPA, Milan (IT)

(72) Inventor: Pier Francesco Piccioni, Milan (IT)

(73) Assignee: VETRERIA DI BORGONOVO SPA, Milan (IT)

( * ) Notice: Subject to any disclaimer, the term of this patent is extended or adjusted under 35 U.S.C. 154(b) by 152 days.

(21) Appl. No.: 18/554,415

(22) PCT Filed: Apr. 11, 2022

(86) PCT No.: PCT/IT2022/050092
§ 371 (c)(1),
(2) Date: Oct. 6, 2023

(87) PCT Pub. No.: WO2022/219658
PCT Pub. Date: Oct. 20, 2022

(65) Prior Publication Data

US 2024/0228127 A1 Jul. 11, 2024

(30) Foreign Application Priority Data

Apr. 13, 2021 (IT) ..... 102021000009161
Apr. 13, 2021 (IT) ..... 102021000009167

(51) Int. Cl.
*B65D 43/02* (2006.01)

(52) U.S. Cl.
CPC ..... *B65D 43/0231* (2013.01); *B65D 2543/00231* (2013.01); *B65D 2543/00296* (2013.01); *B65D 2543/00851* (2013.01)

(58) Field of Classification Search
CPC ..... B65D 2543/00231; B65D 43/0231
See application file for complete search history.

(56) References Cited

U.S. PATENT DOCUMENTS 1,431,911 A 10/1922 Waller
2004/0200839 A1* 10/2004 Conti ..... B65D 25/2888 220/288

(Continued)

FOREIGN PATENT DOCUMENTS

DE 8402183 U1 4/1984
EP 1120091 A1 8/2001
WO 2011147036 A1 12/2011

OTHER PUBLICATIONS

International Search Report for PCT/IT2022/050092 dated May 11, 2022, 4 pages.

(Continued)

*Primary Examiner* — Jeffrey R Allen
(74) *Attorney, Agent, or Firm* — NIXON & VANDERHYE

(57) ABSTRACT

A practical and useful cover or cap to be screwed/unscrewed manually by a user onto a container includes a plastic body exhibiting a recess or recess or a bar, both sized to be gripped by all or part or some of the index through little fingers, side by side, of the user's hand, providing a manual grip or handle for the same user, when screwing the cap on/off the container. The recess is formed between upper and lower walls. The bar extends along a side upper cup of the cover or cap. The cover or cap allows an easy and convenient portability, with one hand, of the container on which the cover or cap is screwed, and also satisfies the user's need to firmly and easily screw the cover or cap onto the container with a high torque, and to unscrew it easily from the same container.

10 Claims, 20 Drawing Sheets

(a)

(b)

(56) References Cited

U.S. PATENT DOCUMENTS

| | | | | |
|---|---|---|---|---|
| 2016/0130042 | A1* | 5/2016 | Gascoine | B65D 25/14 220/288 |
| 2017/0233160 | A1* | 8/2017 | Hudson | B65D 77/062 222/183 |
| 2022/0306353 | A1* | 9/2022 | Yajko | B65D 1/0246 |

OTHER PUBLICATIONS

Written Opinion of the ISA for PCT/IT2022/050092 dated May 11, 2022, 6 pages.

* cited by examiner

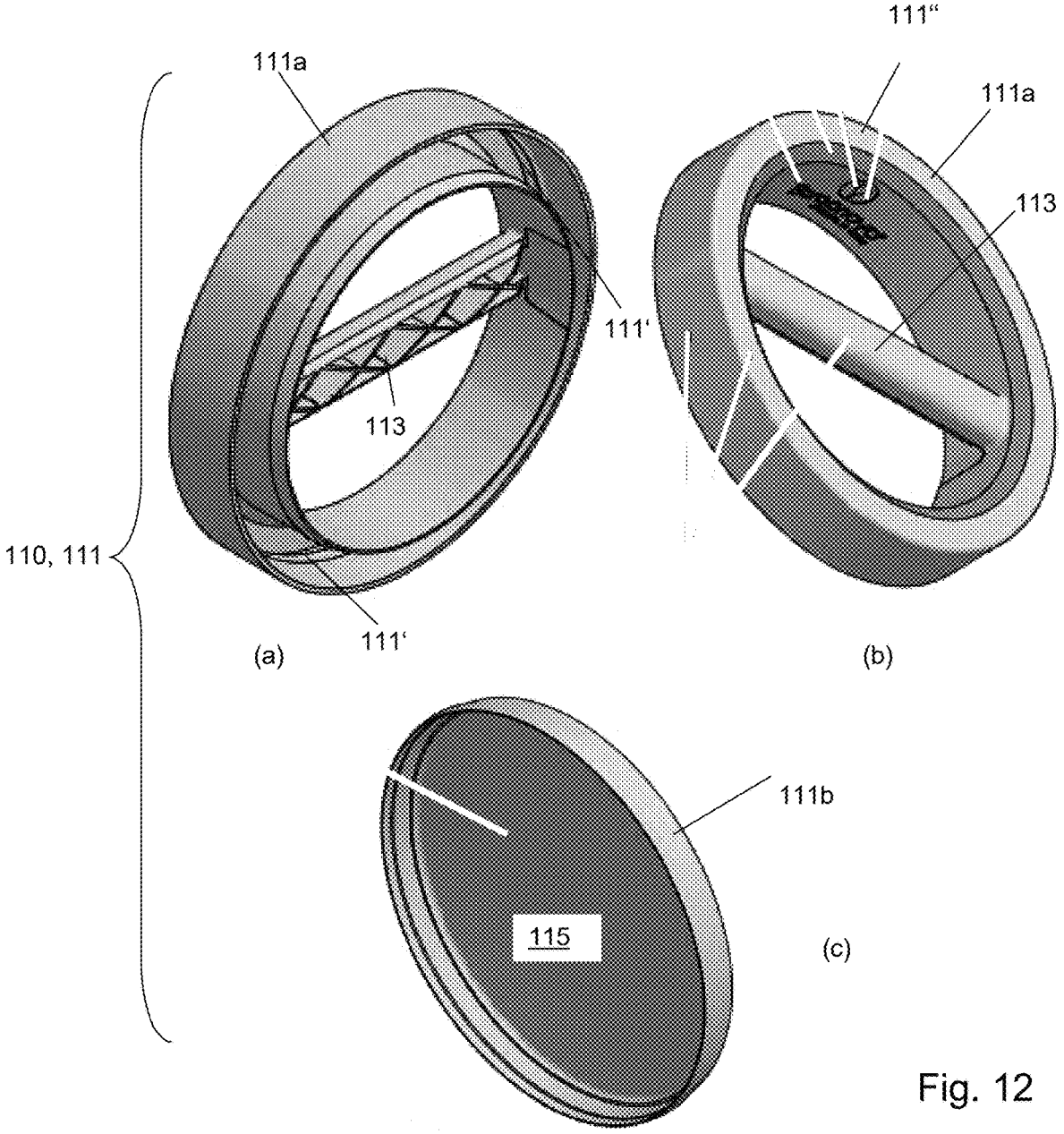
Fig. 12
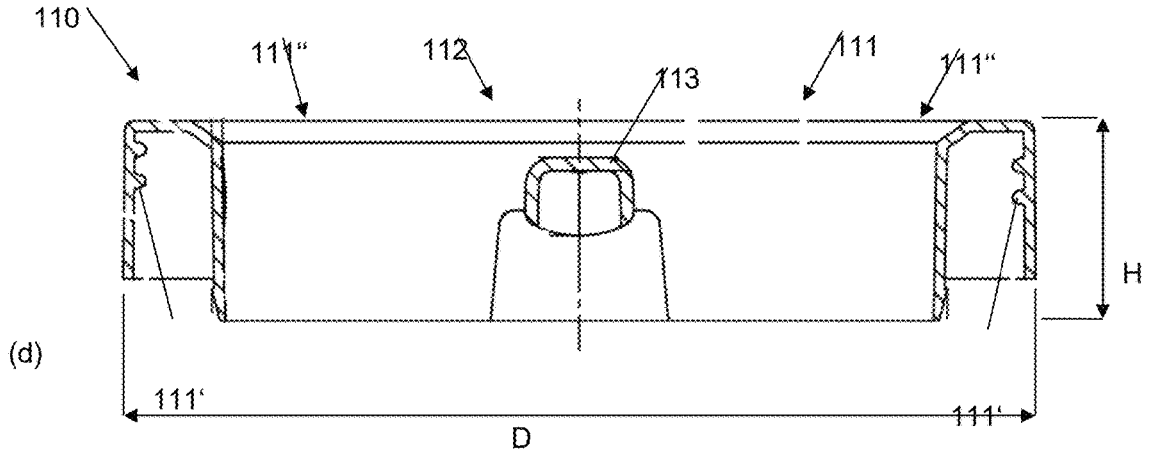

COVER OR CAP SCREWABLE ONTO A CONTAINER, IN PARTICULAR OF GLASS, WITH A MANUAL GRIP FORMED BY A RECESS OR A BAR

CROSS-REFERENCE TO RELATED APPLICATIONS

This application is the U.S. national phase of International Application No. PCT/IT2022/050092 filed Apr. 11, 2022 which designated the U.S. and claims priority to IT 102021000009161 filed Apr. 13, 2021, and IT 102021000009167 filed Apr. 13, 2021, the entire contents of each of which are hereby incorporated by reference.

FIELD OF THE INVENTION

The invention relates in general to the sector of covers, lids, caps and the like, provided for closing and sealing a container, a vessel, a recipient, a can, or a similar article, and more particularly it relates to a new and useful cover or lid or cap, adapted to be screwed/unscrewed by a user onto/from a generic container, for example of glass, which innovates with respect to the covers and lids and caps currently known and available in the market and in particular offers and is associated with useful and advantageous performances, such as that of allowing an easy and convenient transport of the container on which the cover or lid or cap is screwed, and that of closing and sealing the same container stably.

The invention also relates to a corresponding container closed and sealed by the new cover or cap as briefly illustrated above.

THE STATE OF THE KNOWN ART

Everyone knows the need and the usefulness either of screwing a cover, a lid or a cap firmly and stably on a container or a similar item, in order to be sure that the container is sealed and closed well, once the cover or the lid or the cap has been screwed onto the same container, or of unscrewing easily, if necessary, a cover a lid or a cap from a container or a similar item, even when the cover or the lid or the cap has previously been screwed and tightened on the same container with a high and excessive force or torque.

Unfortunately, the present conventional covers or lids or caps, as offered by the prior art, provided to be screwed/unscrewed onto/from a container or a similar article, are not always able to fully satisfy the above need.

In fact, it occurs that, very often, a user encounters problems when firmly and stably screwing a conventional cover or cap to a container, i.e. he not always is able to apply a sufficient force or torque so as to screw the cover or cap firmly and securely onto the container.

It follows that, with these conventional covers or caps, the user is never sure, after screwing the cover or cap onto the container, that the latter is closed well and in a firmly and stable manner, i.e. that the screwing between the cover or cap and the container cannot be loosened, with the consequent unscrewing of the cover or cap from the container itself.

This need is particularly felt in the case of relatively large containers with a certain capacity, which are therefore closed and sealed by corresponding covers and caps, also relatively large and of a certain diameter, which in turn must be screwed with a not negligible and often even high force.

Similarly, a user, using a conventional cover or cap, very often has difficulty when unscrewing the cover or cap from the container, especially if the cover or cap had previously been screwed onto the container with excessive force or torque.

Unfortunately, as already pointed out, it is observed that in the prior art the problem of making the screwing of a cover or cap on a container more secure and firm and facilitating the subsequent unscrewing of the cover or cap from the same container is at least apparently rather neglected.

In fact, the current conventional covers or caps, in particular those of a certain diameter, usually do not provide specific and particular arrangements such as to make them suitable both to be firmly screwed and to be easily unscrewed, if necessary, onto/from a respective container, whereby, in addition to not ensure a stable and secure closure of the cover or cap on a container, they are also inconvenient and uncomfortable to use.

Therefore, with these conventional covers or caps, the possibility of screwing them firmly and stably by a user to a container, as well as the possibility of unscrewing them easily from the same container afterwards, it is in fact dependent on the user's capability to manually apply a sufficient force or torque to screw/unscrew the cover or cap onto/from the container, so that if the user is unable and not capable of applying this sufficient force or torque there is a risk that the cover or cap may loosen over time.

Moreover, the actual containers, once sealed and closed by the respective covers and caps, in particular when these containers are of great capacity and of considerable size, are very often uncomfortable and impractical to move and transport, and in any case they require particular attention and special precautions, like that of being held stably by the user with his two hands, in order to be moved and transported safely.

This limit of a not always easy and convenient transportability occurs both for containers, currently offered on the market, closed and sealed by covers and caps screwed on the same containers, and for containers closed and sealed in other ways, for example by covers and caps associated with hooks and spring systems.

For the sake of completeness, FIG. 7, divided into sections (a)-(b), shows some examples of glass containers, currently offered in the market, which are closed and sealed by covers and caps of conventional type and therefore have the limits illustrated here before and above all that of an uneasy transportability.

SUMMARY OF THE INVENTION

Therefore, in the light of the above-described context, the primary object of the present invention is to provide a new cover or cap, practical and convenient to use, which can be screwed/unscrewed onto/from a container, a vessel, a recipient, a can or a similar article, which is able to overcome the drawbacks of the conventional covers and caps, as offered by the prior art and currently in use in the market, and in particular it is able to be firmly screwed onto the container so as not to be subject to unscrewing and loosening over time, and it is also suitable to be easily unscrewed, even after it has been screwed onto a container with a high screwing force or torque.

Another object, no less important than the preceding one, of the invention can also be identified in that of providing a new cover or cap, which can be screwed onto a container or a similar article, which offers and is associated with advantageous additional functions, in addition to closing and sealing the container, and in particular it allows an easy and convenient handling and transportability of the container on which the cover or cap is screwed.

Finally, a further object of the present invention is also to provide a new cover or cap of the type that can be screwed/unscrewed onto/from a container or a recipient or a similar article, which, in addition to allowing a user to screw firmly and easily unscrew the same cover or cap on/from the container, it also has a configuration simple and achievable in an industrial way with low costs.

The above objects can be considered fully achieved by the cover or cap, suitable to be screwed/unscrewed onto/from a container, having the characteristics recited by the independent claims 1 and 8, which therefore has, along an upper surface or face thereof, a manual grip or handle, in particular formed by a recess or by a bar, able to receive and be gripped by the fingers and palm of a user's hand, when he screws/unscrews the cover or cap onto/from the container.

Particular embodiments of the new cover or cap which can be screwed/unscrewed onto/from a container are further defined by the dependent claims.

ADVANTAGES OF THE INVENTION

As it will become better apparent in the following description, the new cover or cap, which can be screwed/unscrewed onto/from a container or a similar article or object, according to the present invention, offers a series of significant and unique advantages, partly already previously announced, among which the following are mentioned purely by way of example:

- an easy transportability of the container on which the cap is screwed, thanks to the manual grip, in particular formed by a recess or a bar on the upper surface or face of the cap, which allows a user to easily grip and transport the container with one hand;
- a comfortable and easy screwing/unscrewing of the cap on/from the container, again thanks to the manual grip, formed on the upper surface or face of the cap, which allows the user to grip the cap stably and to apply on it a suitable torque or force, when screwing/unscrewing the cap on/from the container;
- a practical, safe and advantageous use, also for closing and sealing containers of considerable dimensions, i.e. having mouths which require to be closed and sealed with covers and caps also of considerable size;
- a low and competitive production cost.

BRIEF DESCRIPTION OF THE DRAWINGS

These and other objects, features and advantages of the invention will become apparent from the following description of some preferred embodiments thereof, given purely by way of example with reference to the accompanying drawings, in which:

FIG. 12, divided into sections (a)-(d), is a series of graphical views showing in perspective and in section the parts constituting the cover or cap of FIG. 7 of the invention.

DESCRIPTION OF A FIRST PREFERRED EMBODIMENT OF THE COVER OR CAP, ACCORDING TO THE PRESENT INVENTION, WHICH CAN BE SCREWED/UNSCREWED ONTO/FROM A CONTAINER OR A SIMILAR ARTICLE AND OBJECT

Figure 1A:
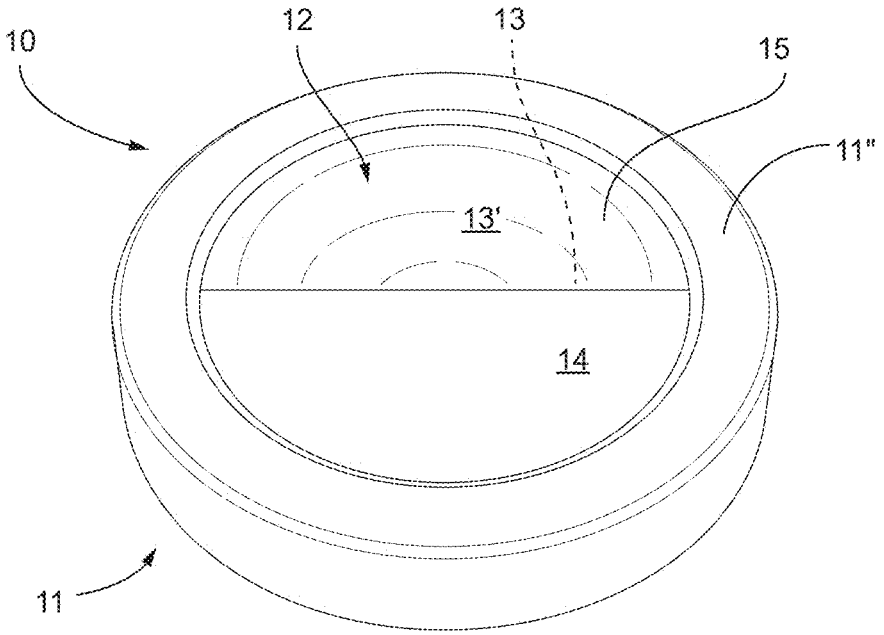
FIG. 1, divided into sections (a)-(d), is a series of photographic images showing from different observation points, either from the top or from the bottom, an example of a cover or cap according to a first embodiment of the present invention.
Figure 1B:
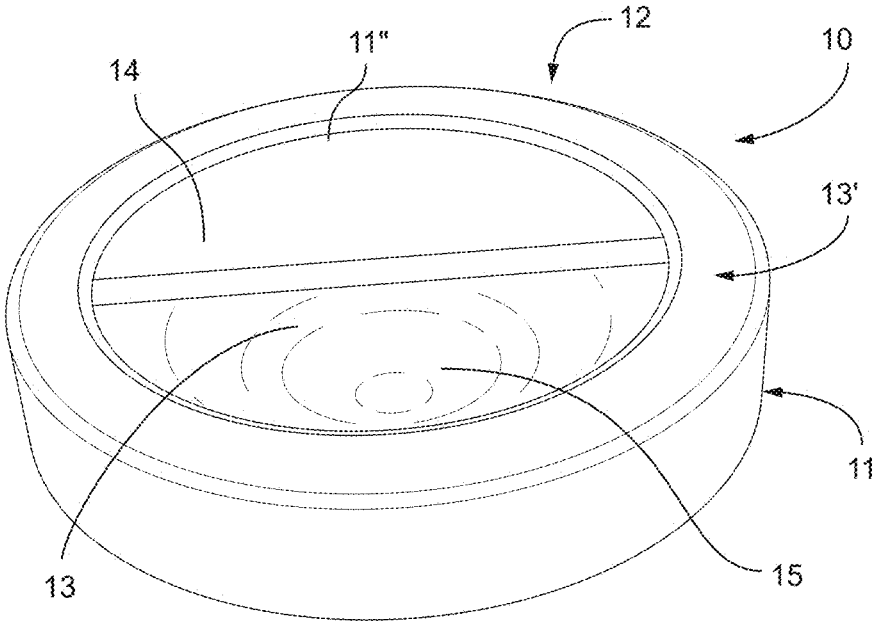
Figure 1C:
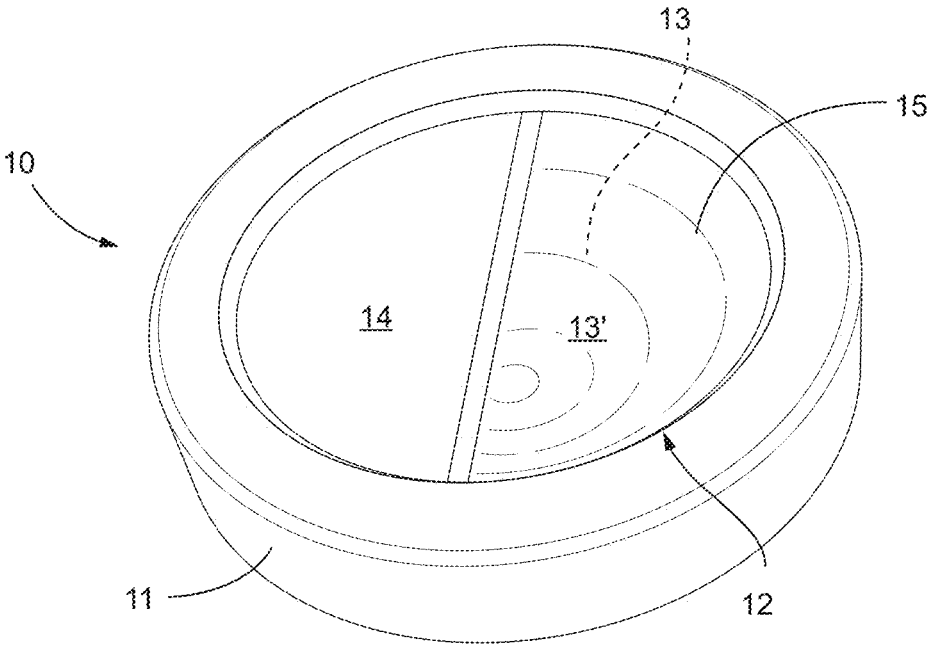
Figure 1D:
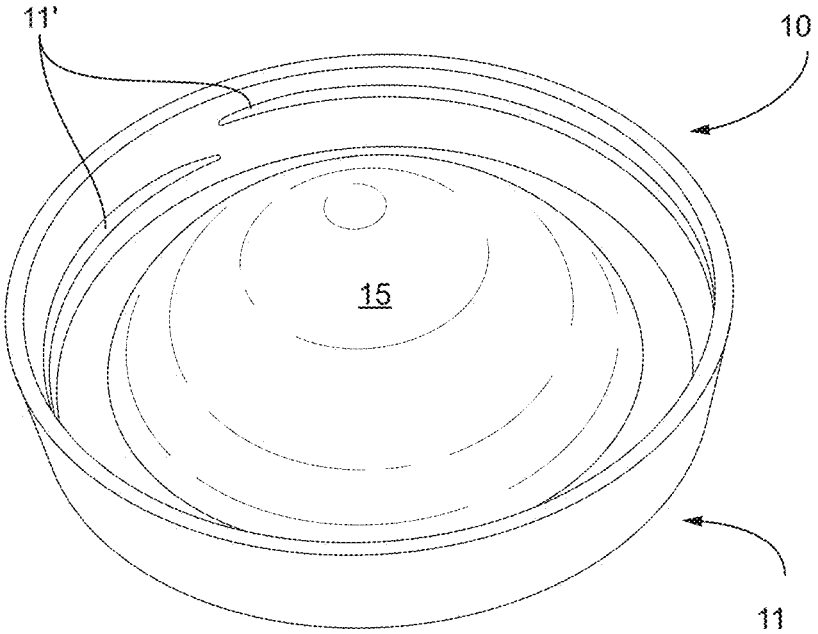
Figure 2:
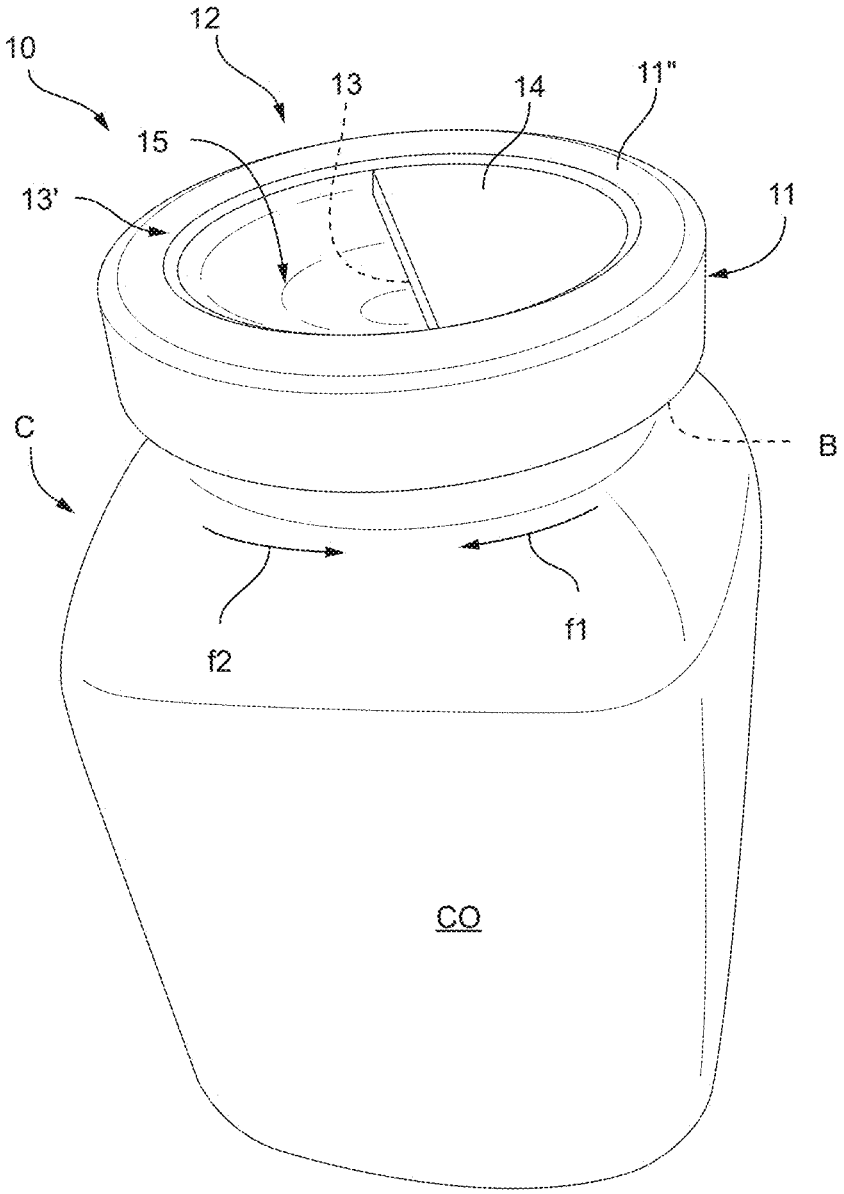
FIG. 2 is a photographic image showing a container on which the cover or cap of FIG. 1, according to the invention, is screwed.
Figure 3:
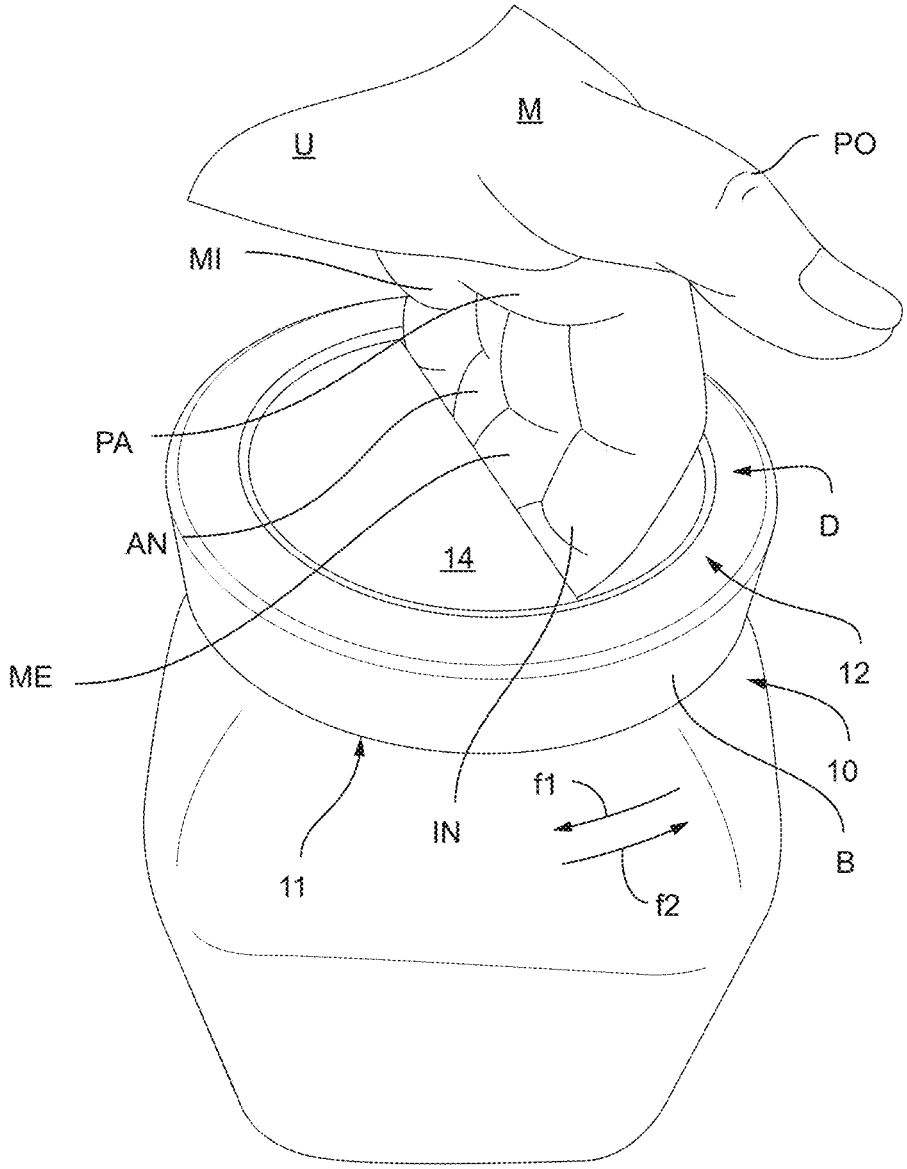
FIG. 3 is a photographic image showing the container FIG. 2 in use, i.e. during manual screwing on it of the cover or cap of FIG. 1.
Figure 4A:
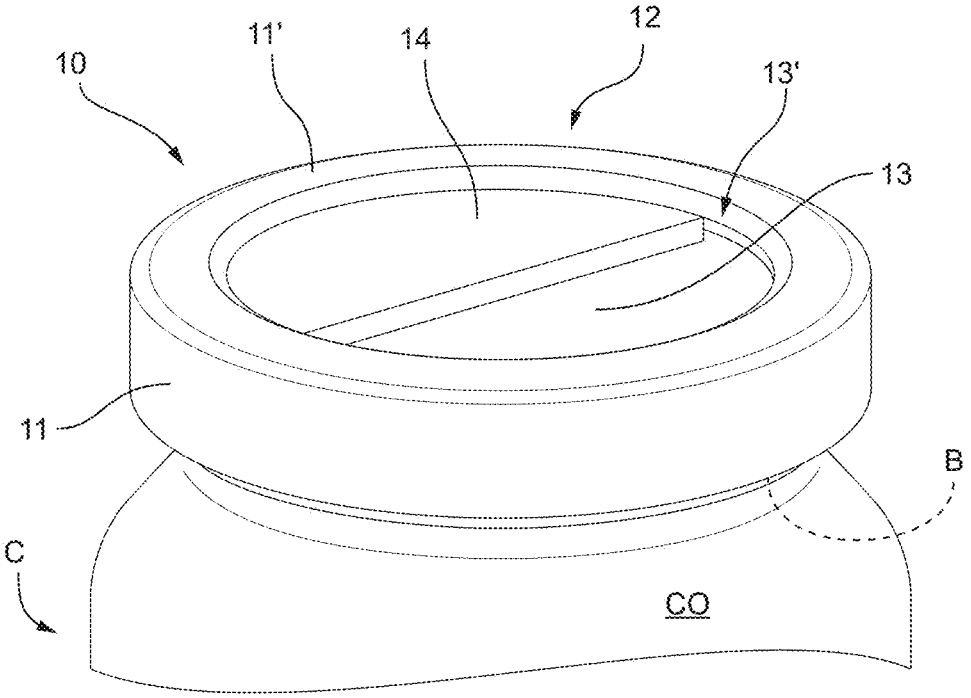
FIG. 4, divided into sections (a)-(f), is a series of graphic views and photographic images, in addition to the previous photographic images, showing the cover or cap of FIG. 1, according to the first embodiment of the invention, and the respective container on which the cover or cap is screwed.
Figure 4B:
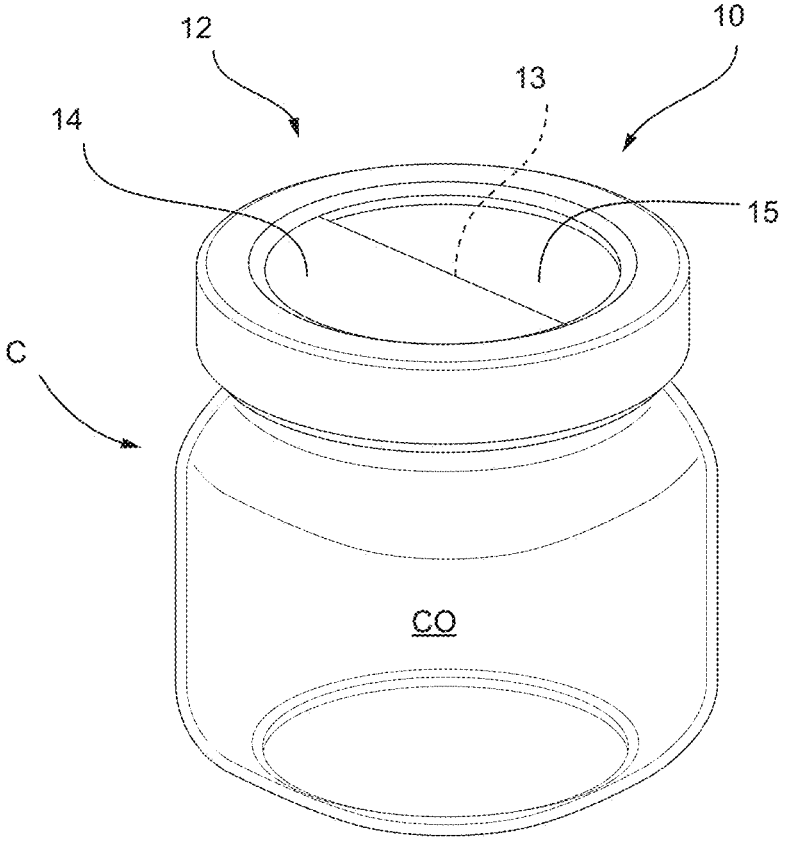
Figure 4C:
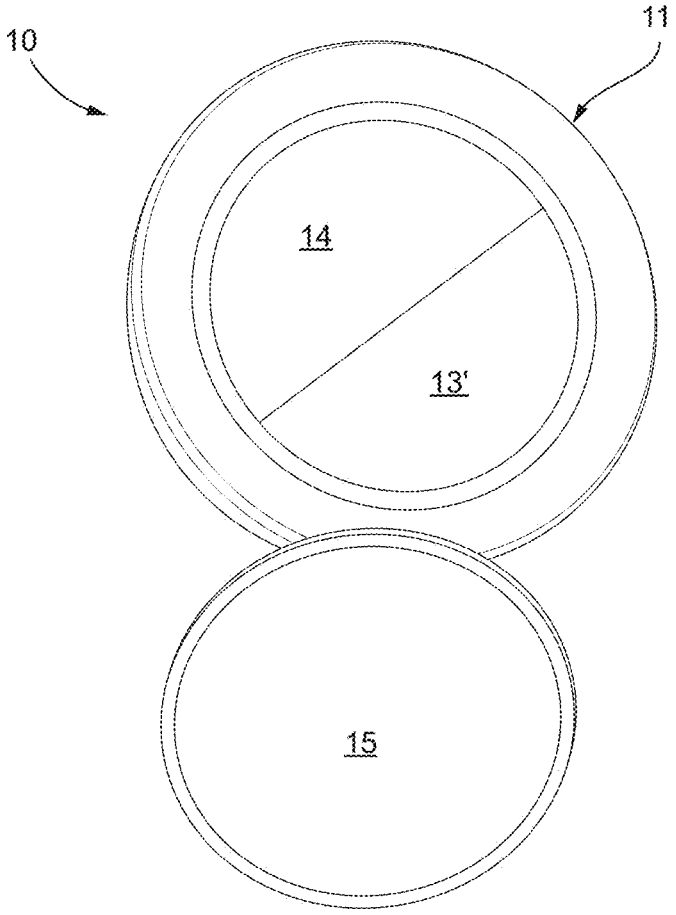
Figure 4D:
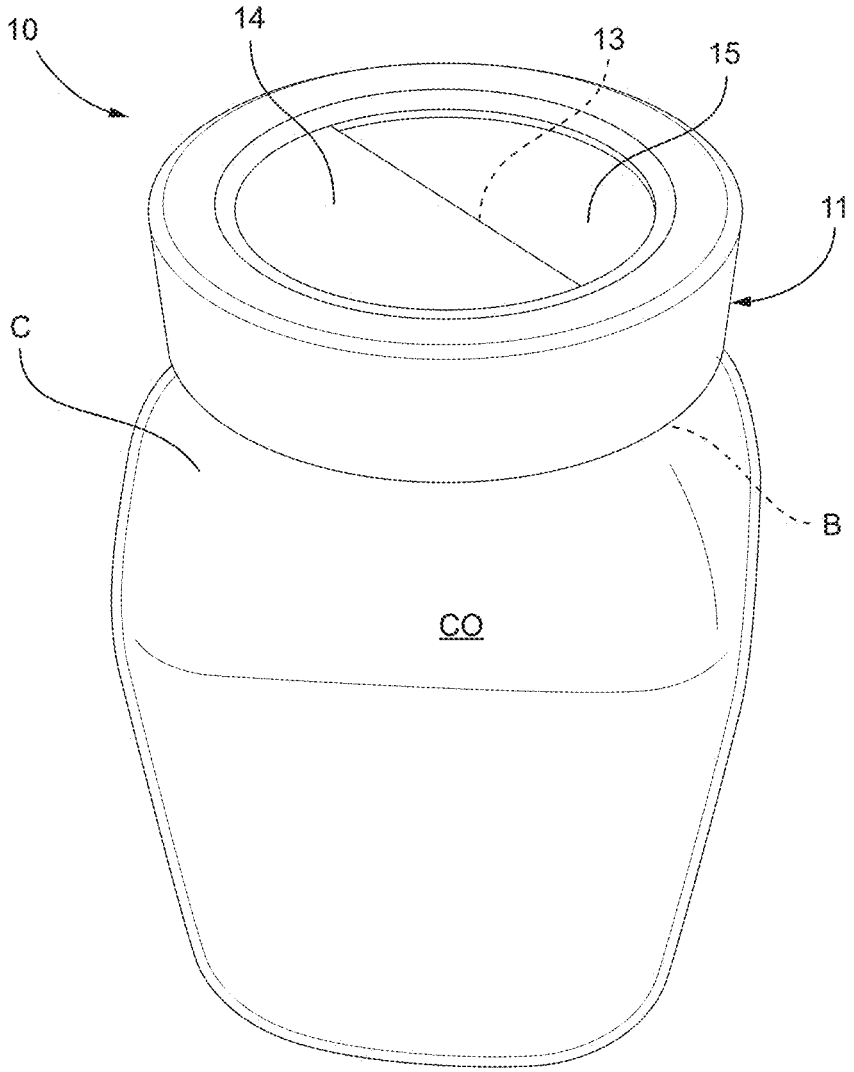
Figure 4E:
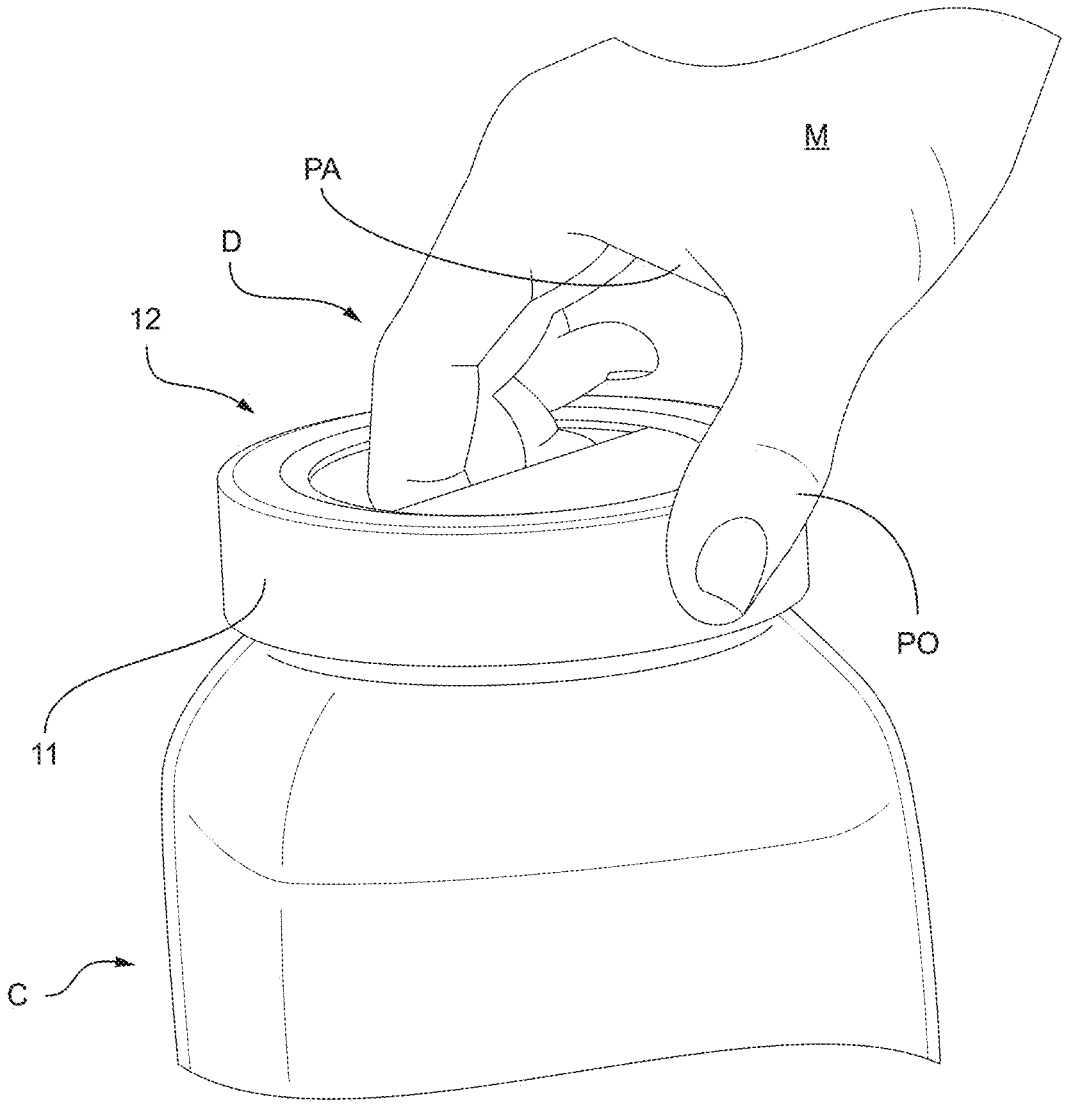
Figure 4F:
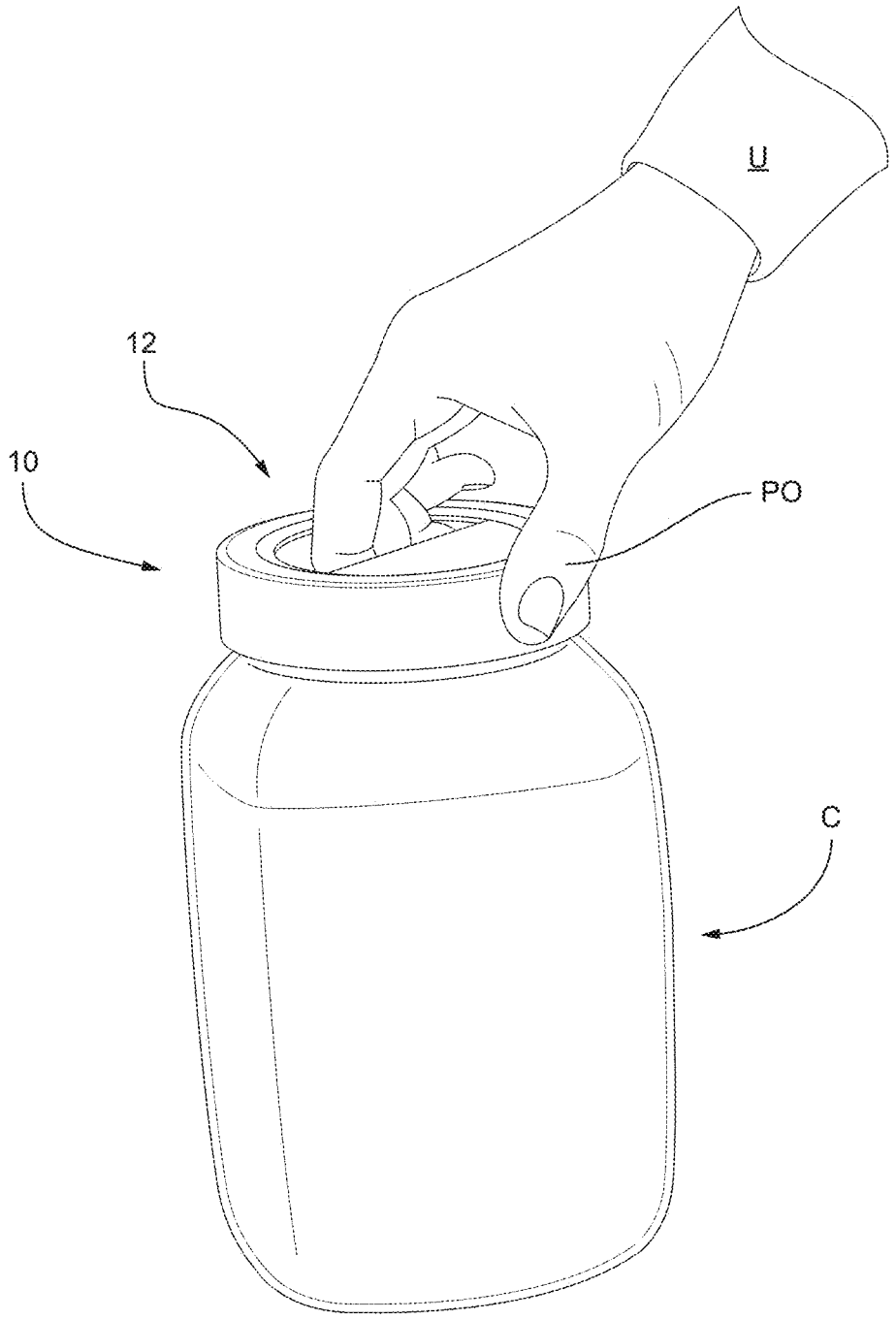

With reference to the drawings, and in particular to FIGS. 1-3, a cover or cap or lid, hereinafter also synthetically referred to and called cap, according to a first embodiment of the present invention, adapted to be screwed/unscrewed manually by a user U on/from a container C, a vessel, a recipient, a receptacle, a can or a similar article, is generally indicated with 10.

The container C on which the cap 10 can be screwed and from which it can be unscrewed can be a usual container or container made of various materials and in particular glass, having a main body CO which defines at the top a threaded mouth B on which and from which the cap 10 can be screwed and unscrewed.

In detail, the cap 10 of the invention comprises:

- a main body, indicated with 11, made by moulding a plastic material, having a circular shape with an outer collar internally exhibiting a thread 11' adapted to be screwed onto the threaded mouth B of the container C, wherein, according to a salient feature of the invention, this body 11, made of plastic material, has, along an upper surface or face 11" thereof, a manual grip or handle, generally indicated with 12, suitable for receiving and being gripped by the fingers D and the palm PA of the user's hand M, when screwing/unscrewing the cap 10 on/from the same container C.

In greater detail, as clearly shown in the drawings, this manual grip or handle 12 is formed by:

a recess, designated by the reference numeral 13, which extends deep into the body 11 of the cover or cap 10 and is dimensioned so as to be able to receive and house all or some of the four index finger IN, middle finger ME, ring finger AN, and little finger MI, side by side, of the hand M of the user U.

Moreover, this recess 13 has an opening 13' on the upper surface or face 11" of the body 11 of the cap 10 and is in turn formed between a substantially flat upper wall 14 which extends along the upper face 11" of the body 11 of the cap 10 and a concave lower wall 15 extending along a lower face of the body 11 of the cap 10.

Therefore, thanks to the aforesaid configuration of the cap 10, the upper wall 14 is able to be gripped by the fingers D and by the palm PA of the user's hand M, with the respective four index finger IN, middle finger ME, ring finger AN and little finger MI, side by side, which are received, all or some, by the recess 13 and with the thumb PO that closes outside the recess 13 on the body 11 of the cap 10, so as to provide the hand grip or handle 12 that can be gripped by the fingers D and the palm PA of the user's hand M, when screwing/unscrewing the cap 10 on/from the container C.

As stated, the body 11 of the cover or cap 10 is made by moulding a plastic material, for example, but not exclusively, propylene.

Figure 6:
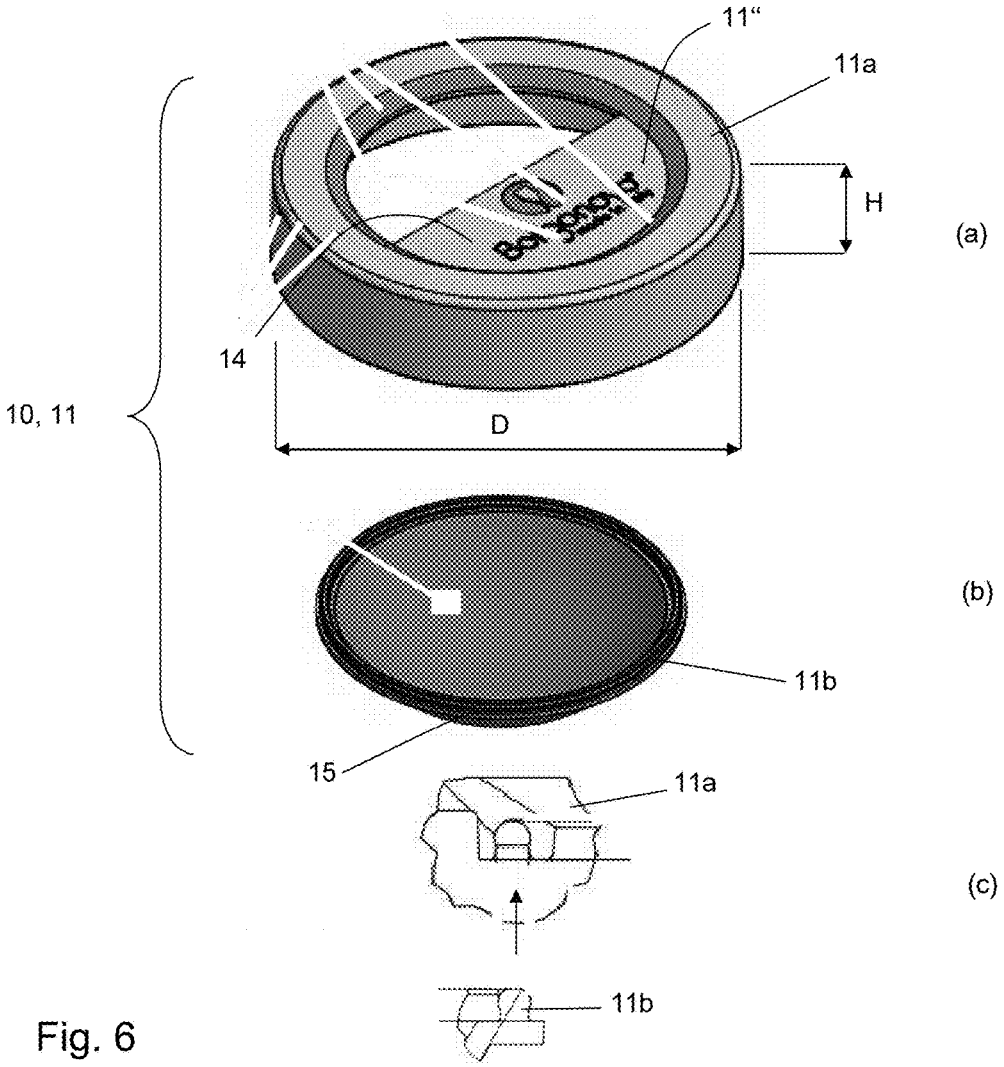
FIG. 6, divided into sections (a)-(c), is a series of graphical views showing in perspective the parts constituting the cover or cap of FIG. 1 of the invention, and in detail how these parts are connected.

Moreover, advantageously, this main body 11 can be constituted by two parts including a first part 11*a* and a second part 11*b*, moulded separately, which can be snap-coupled to each other as indicated by an arrow in FIG. 6-section (c), wherein the part 11*a* defines the flat upper wall 14, and the portion 11*b* defines the lower wall 15, having a lowered dome shape, of the cap 10. The first part 11*a* includes a middle collar 20 and an inner collar 24 defining a first plastic part recess 22. The second plastic part 11*b* includes an upper edge snap 26 coupled into the first plastic part recess 22.

In use, as shown in FIGS. 1-3 the cap 10 is screwed or unscrewed from the container C, as indicated by an arrow F1 and an arrow F2, respectively, by gripping with the fingers and the palm of the user's hand U the handle 12 formed in the same cap 10, that is, by inserting the fingers into the recess 13 and holding the upper wall 14 with the palm of the hand, so as to manually exert the force and therefore the torque necessary to screw the cap 10 firmly or unscrew the container C.

For a clearer and more complete information, FIG. 4, divided into sections (a)-(f), shows, in addition to the photographic images of FIGS. 1-3, the cap 10 of the invention and the respective container C on which the cap 10 is screwed.

Figure 5:
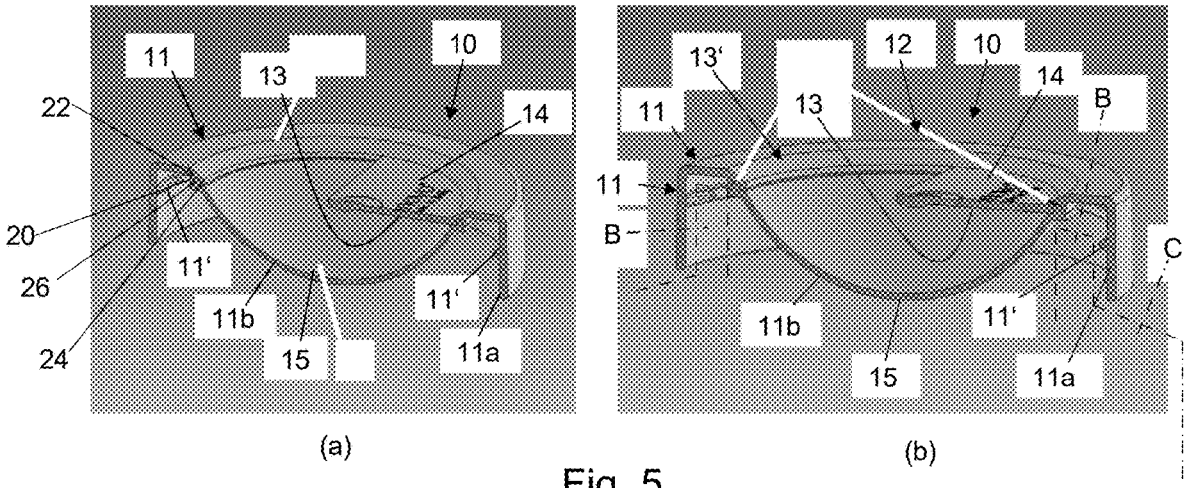
FIG. 5, divided into sections (a)-(b), is a pair of graphical views showing in section the cover of FIG. 1 of the invention.

Moreover, FIG. 5, divided into sections (a)-(b), and FIG. 6, divided into sections (a)-(c), show in section the cap 10 of the invention, the parts 11*a* and 11*b* constituting its main body 11, and the manner in which these parts 11*a* and 11*b* are snap-connected to each other.

Of course, the diameter D and the height H of the cap 10 can assume very different values depending on the diameter and configuration of the threaded mouth B of the container C on which the cap 10 is screwed, and for example, in widely used ranges of variation, they can be comprised respectively between 100 and 120 mm and between 20 and 40 mm.

Figure 7:
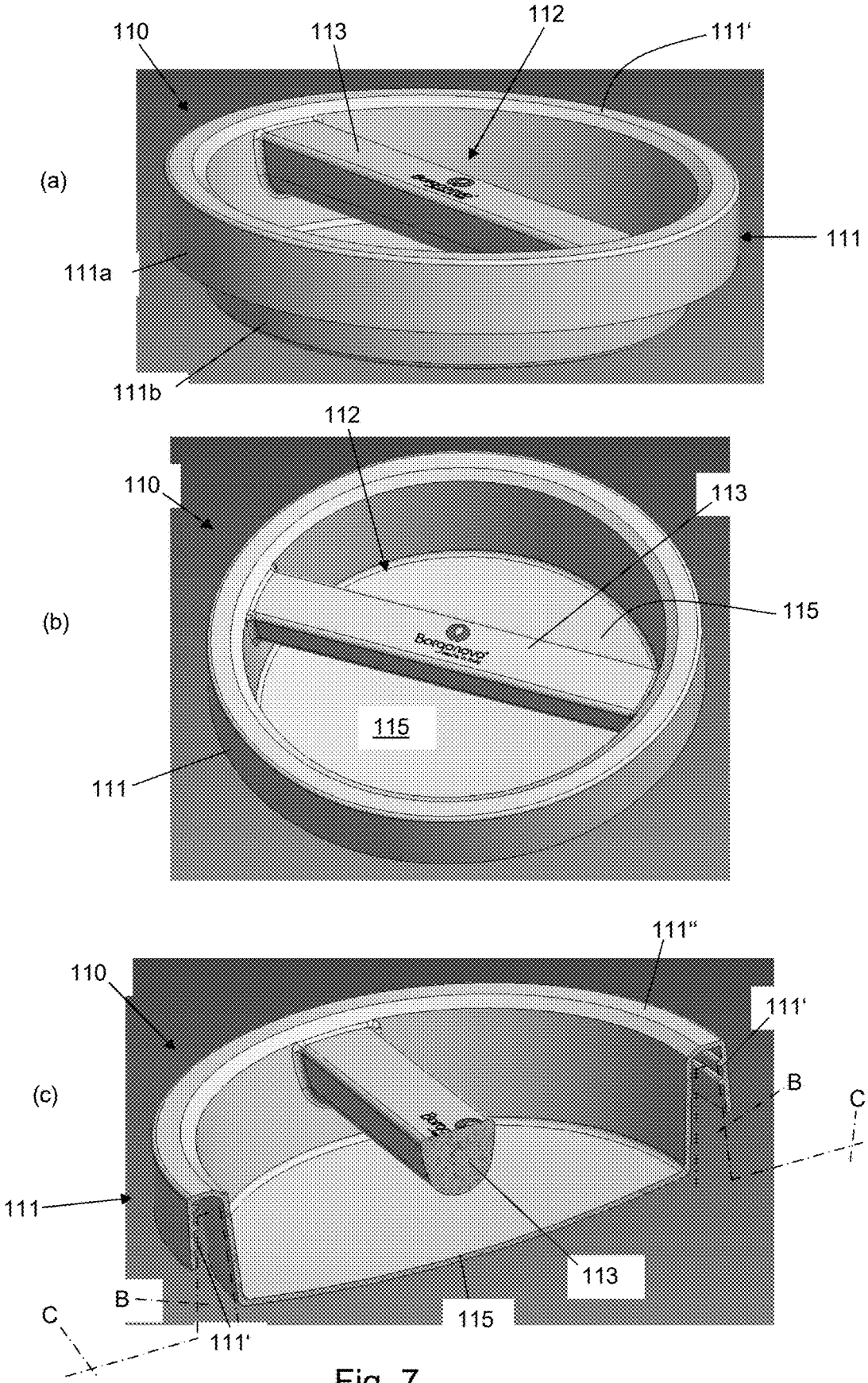
FIG. 7, divided into sections (a)-(c), is a series of graphic views showing in perspective form and in section a cover or cap according to a second embodiment of the invention.
Figure 8:
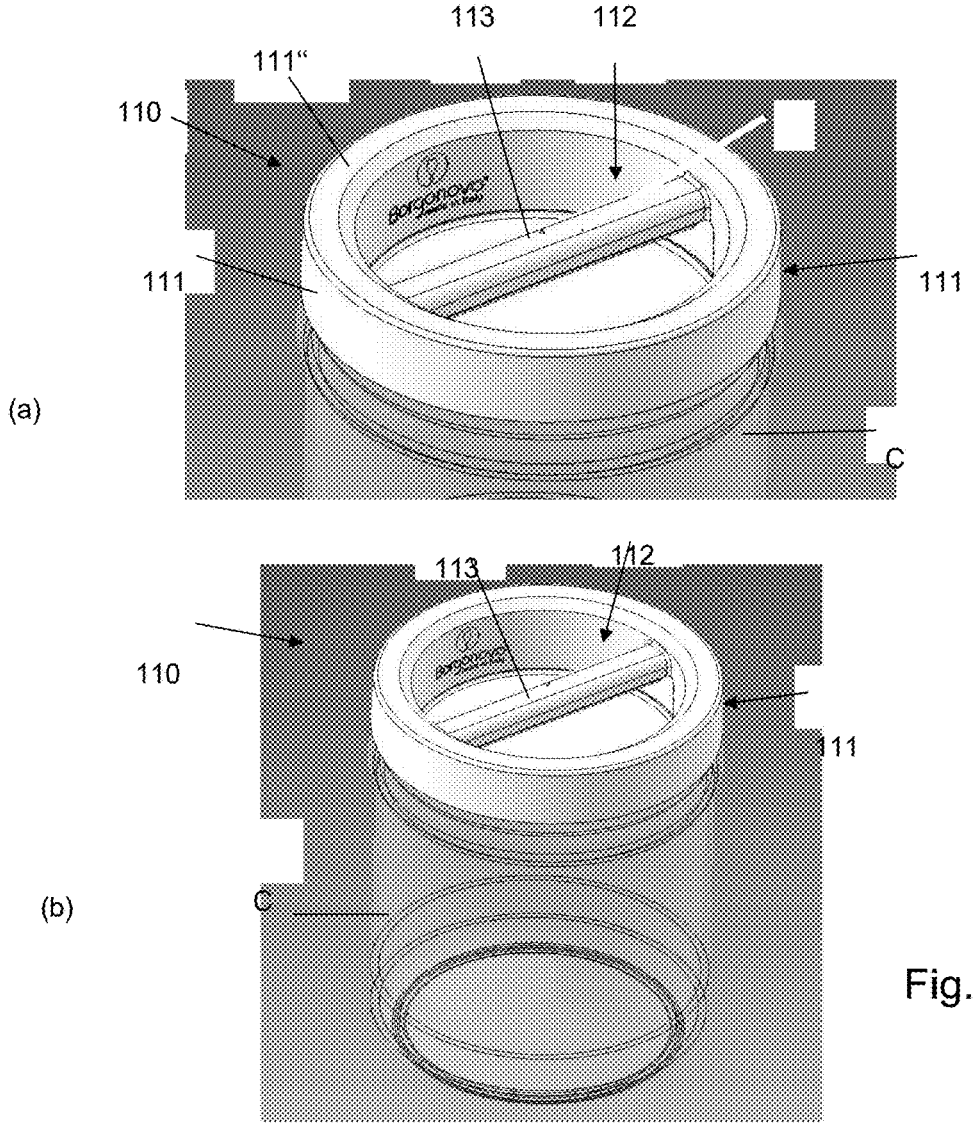
FIG. 8, divided into sections (a)-(b), is a series of graphical views showing the cover or cap of FIG. 7, according to the second embodiment of the invention, screwed onto a container.
Figure 9:
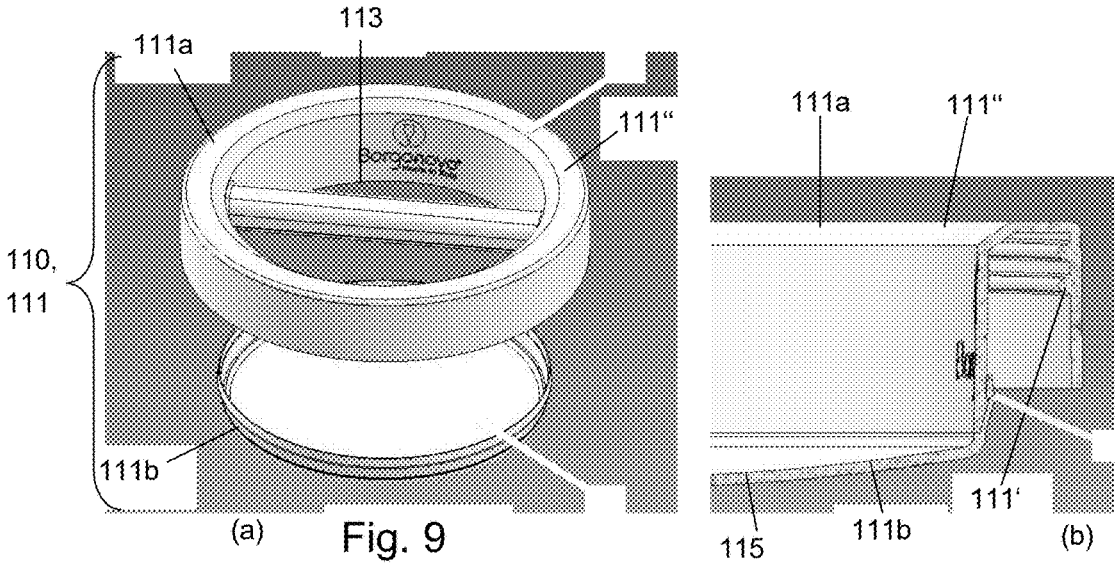
FIG. 9, divided into sections (a)-(b), is a series of graphical views showing the cover or cap of FIG. 7 in broken-out form and some details thereof in enlarged form.

Description of a Second Preferred Embodiment of the Cover or Cap According to the Present Invention, Which can Be Screwed/Unscrewed Onto/From a Container or a Similar Article and Object With reference to the drawings, and in particular to FIGS. 7-9, a cover or lid or cap, hereinafter also synthetically referred to as cap, according to the present invention, adapted to be screwed/unscrewed manually by a user U on/from a container C, a vessel, a recipient, a receptacle, a can or a similar article, is generally indicated with 110.

The container C on which the cap 110 can be screwed and from which it can be unscrewed can be a usual container made of various materials and in particular glass, having a main body CO which defines at the top a threaded mouth B on which and from which the cap 110 can be screwed or unscrewed.

In detail, the cap 110 of the invention comprises:

a main body, indicated with 111, made by moulding a plastic material, having a circular shape with an outer collar internally exhibiting a thread 111' adapted to be screwed onto the threaded mouth B of the container C, wherein, according to a salient feature of the invention, this body 111, made of plastic material, has, along an upper surface or face 111" thereof, a manual grip or handle, generally indicated with 112, suitable for receiving and being gripped by the fingers D and the palm PA of the hand M of the user U, when screwing/unscrewing the cap 110 onto/from the same container C.

In greater detail, as clearly shown in the drawings, this manual grip or handle 112 is formed by:

a bar, indicated with 113, which extends transversely along the upper surface or face 111" of the body 111 of the cover or cap 110 and is dimensioned so as to be adapted to be engaged and embraced by all or a part, that is some of the four index finger IN, middle finger ME, ring finger AN and little finger MI, side by side, of the hand M of the user U.

Therefore, thanks to the aforesaid configuration of the cap 110, the bar 113 is able to be gripped and embraced by the fingers D and the palm PA of the user's hand M, with all or some of the four index finger IN, middle finger ME, ring finger AN and little finger MI which engage and embrace, side by side, the bar 113, and with the thumb finger PO closing on the body 111 of the cover or cap 110, so as to provide the hand grip or handle 112 which can be gripped by the fingers D and the palm PA of the user's hand M, when screwing/unscrewing the cap 110 onto/from the container C.

As stated, the body 111 of the cover or cap 110 is made by moulding a plastic material, for example, but not exclusively, propylene.

Moreover, advantageously, this main body 111 can be constituted by two distinct parts, as shown in FIG. 12, indicated respectively with 111*a* and 111*b*, moulded separately and coupled, for example by snap action, so as to form the main body 111, wherein the part 111*a* defines the bar 113 and the part 111*b* defines a lower wall 115, exhibiting a slightly outwardly convex shape, of the cap 110.

Figure 10A:
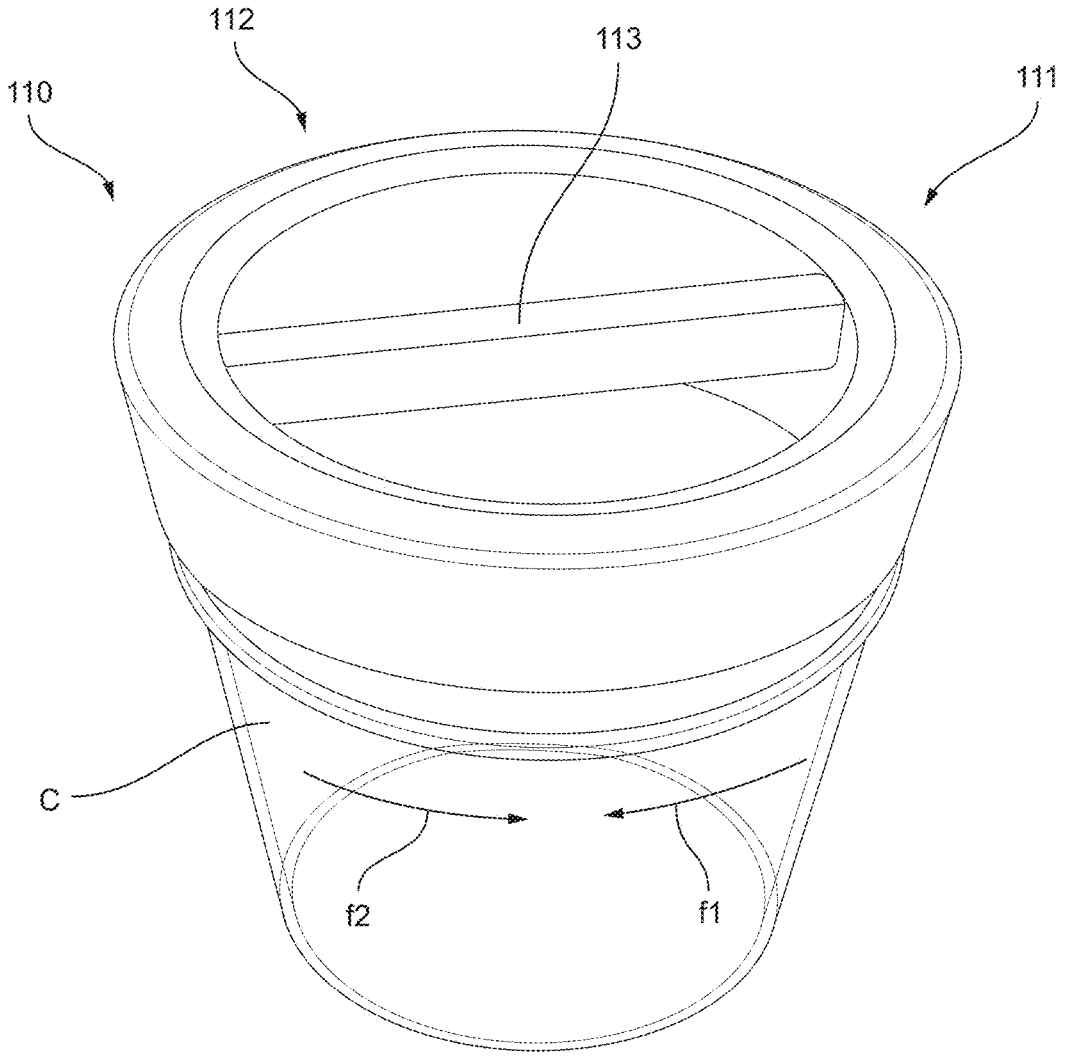
FIG. 10, divided into sections (a)-(c), is a series of photographic images, in addition to the previous graphic views, showing an example of the cap of the invention, according to the second embodiment of the invention, screwed onto a container and in broken-out form.
Figure 10B:
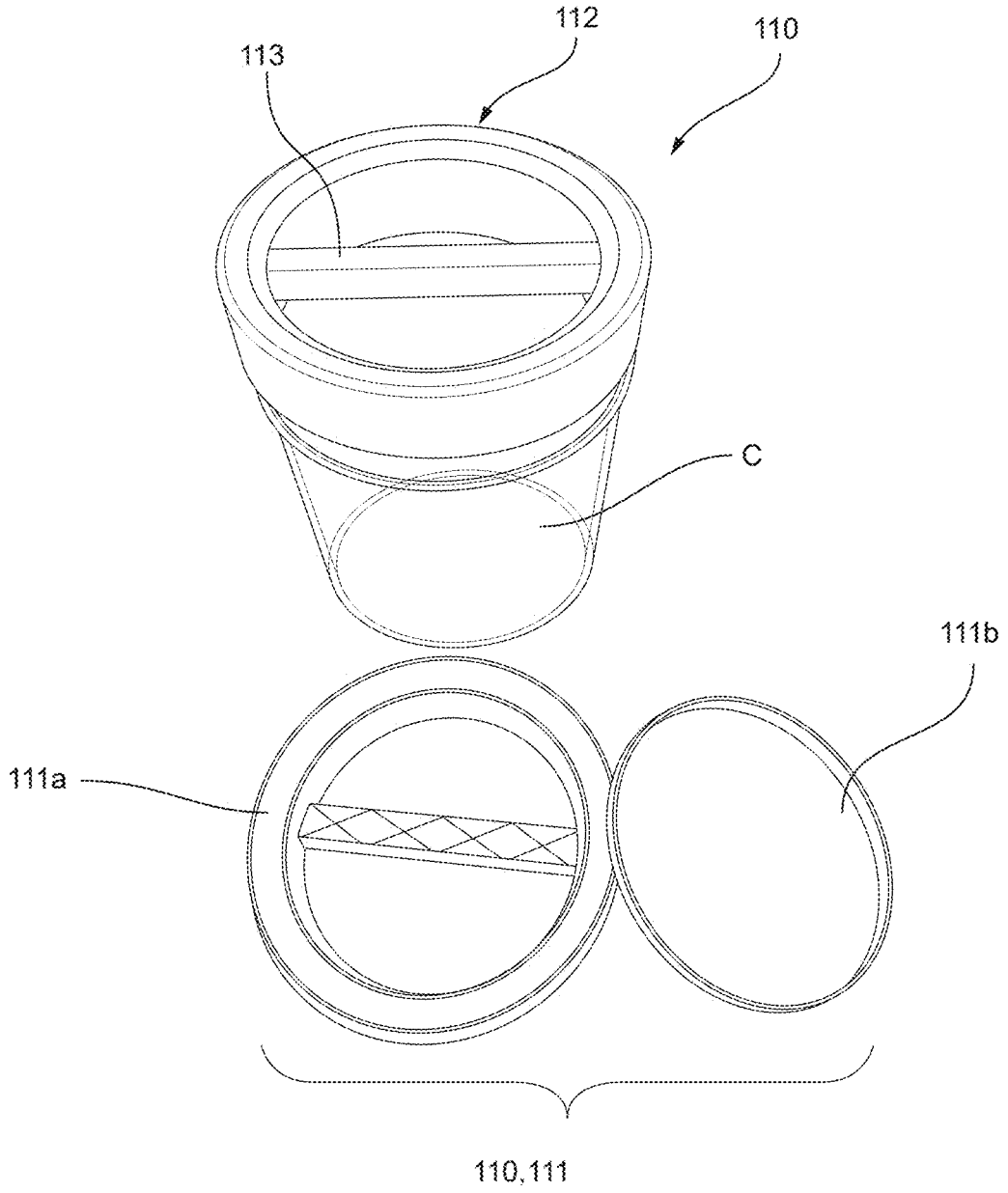
Figure 10C:
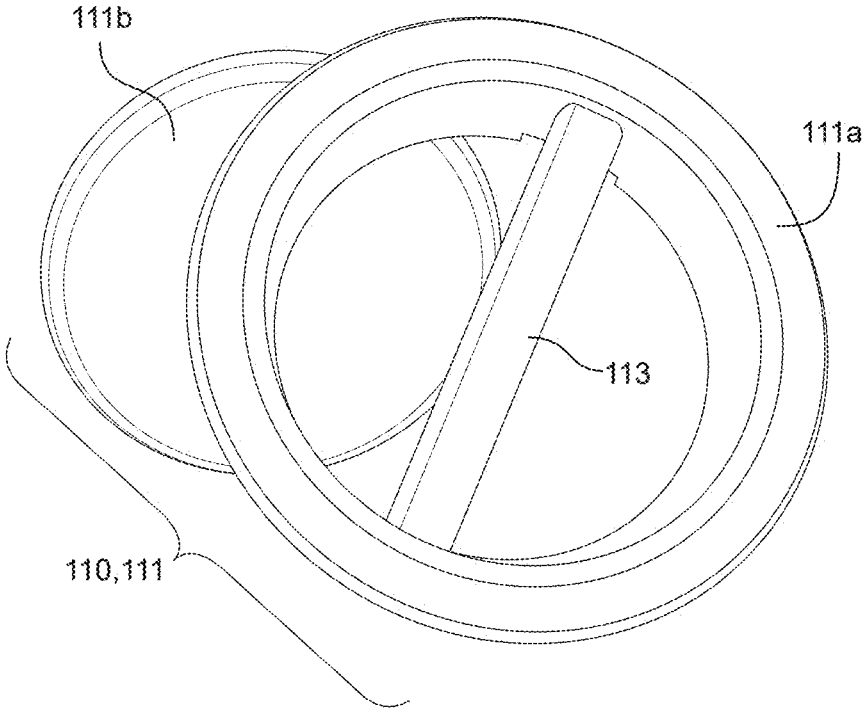
Figure 11A:
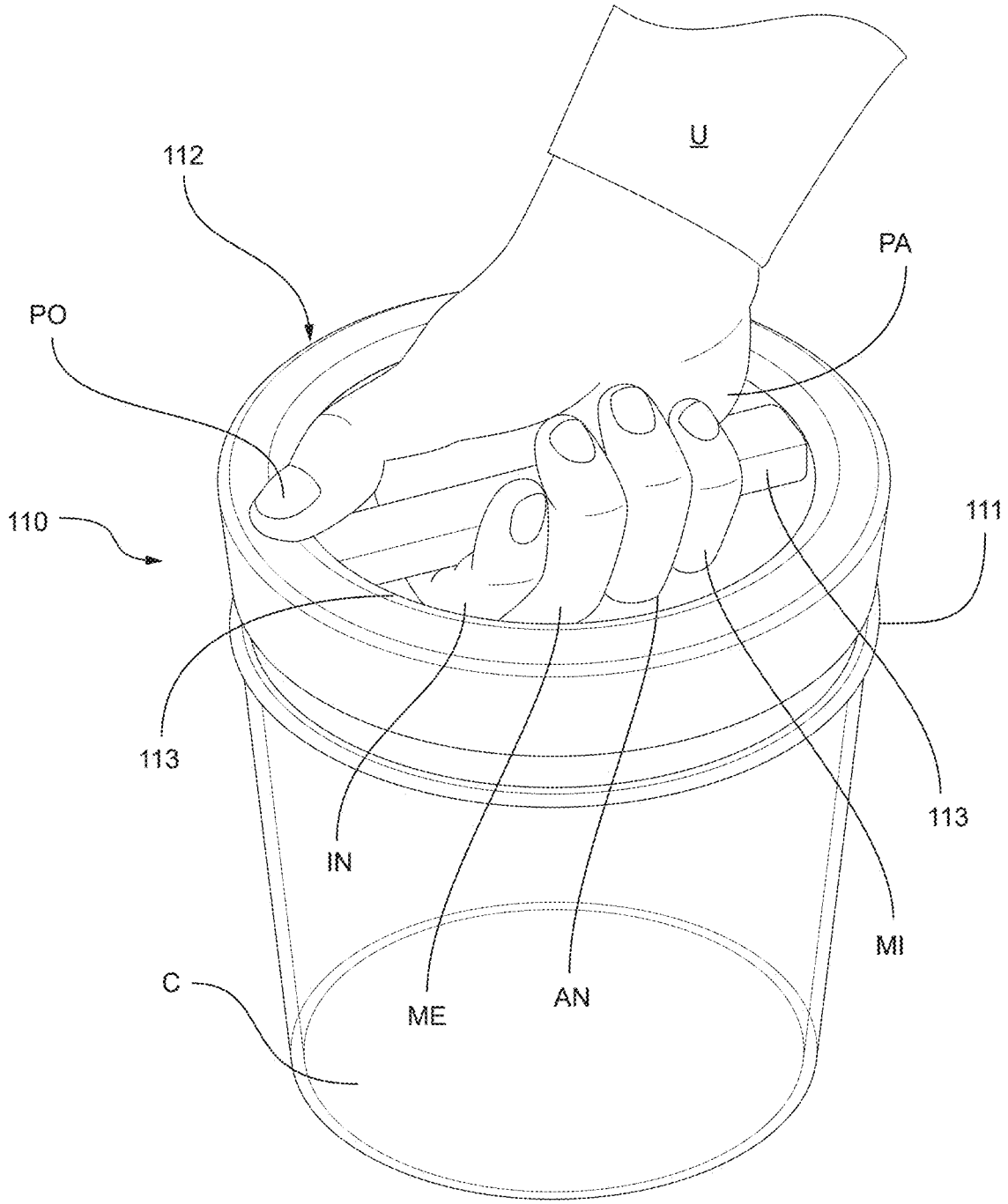
FIG. 11, divided into sections (a)-(b), is a series of photographic images, in addition to the previous graphic views and photographic images, showing an example of the cover or cap of FIG. 7 of the invention in use for transporting the container on which the cap is screwed.
Figure 11B:
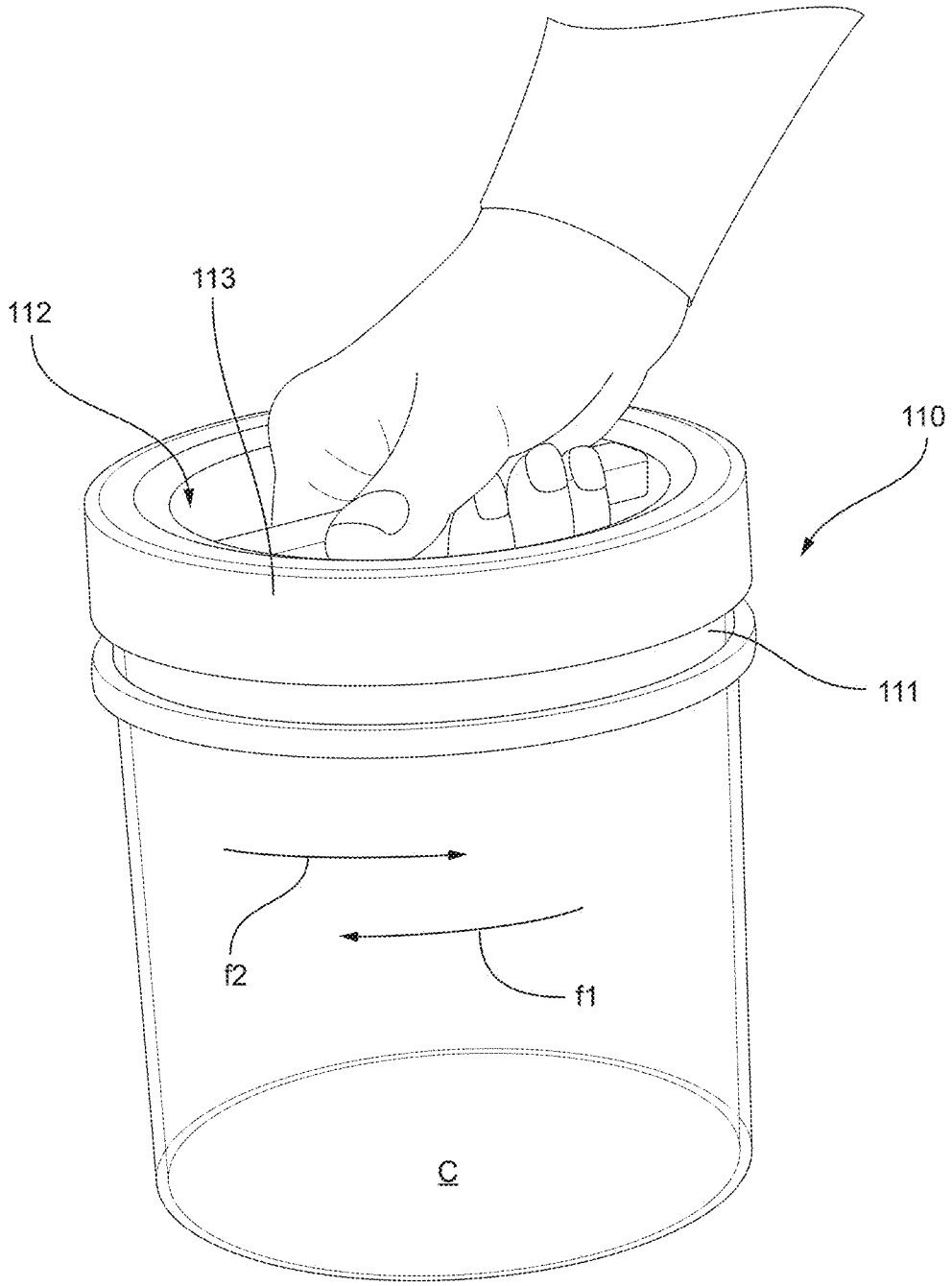
Figure 13A:
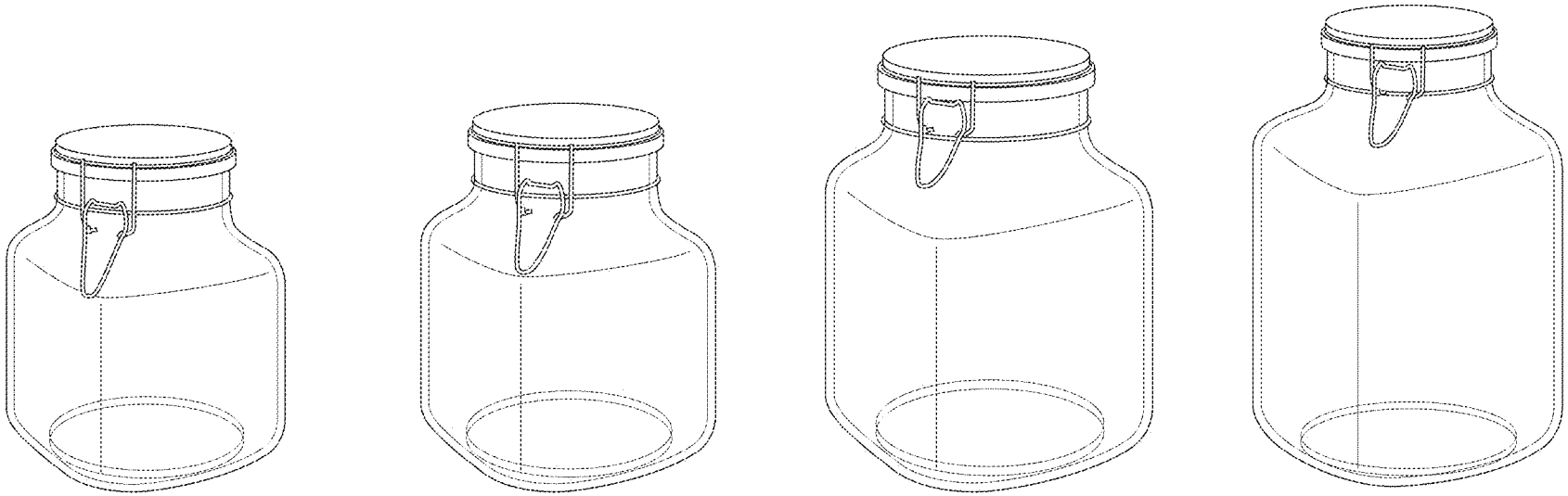
FIG. 13(a) (PRIOR ART)
FIG. 13, divided into sections (a)-(b), is a series of photographic images showing some containers closed by a cover or cap, according to the prior art, which are located in the same field as the present invention.
Figure 13B:
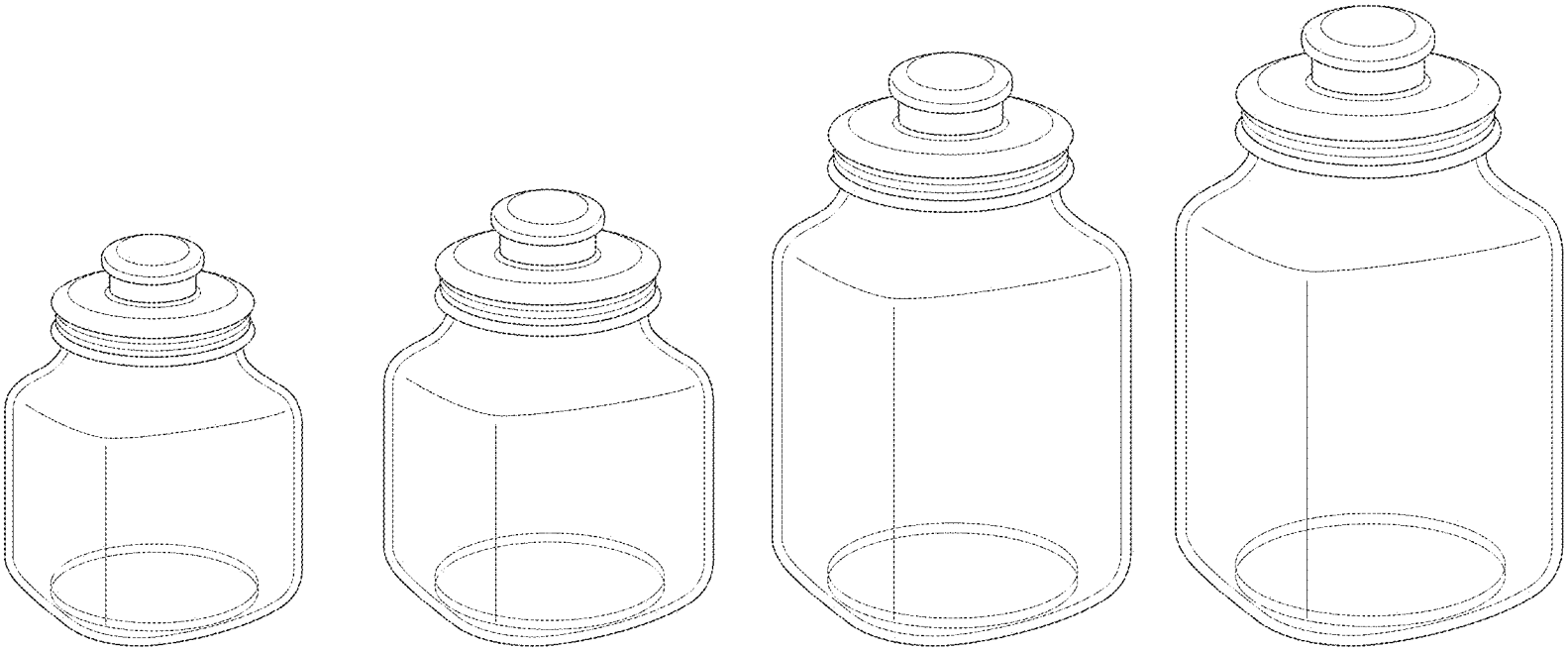
FIG. 13(b) (PRIOR ART)

In use, as shown in FIGS. 10 and 11, the cap 110 is screwed or unscrewed from the container C, as indicated by an arrow F1 and an arrow F2, respectively, by gripping with the fingers and the palm PA of the user's hand U the handle 112, i.e. the bar 113 formed by the body 111, so as to exert manually the force and therefore the torque necessary to screw firmly or unscrew the cap 110 on or from the container C.

Of course, the diameter D and the height H of the cap 110 can assume very different values depending on the diameter and configuration of the threaded mouth B of the container C on which the cap 110 is screwed, and for example, in widely used ranges of variation, they can be comprised between 160 and 200 mm and between 30 and 45 mm respectively.

It is therefore clear from the description made that the present invention fully achieves the intended aim and objects, and in particular proposes a new and useful cover or cap, adapted to be screwed/unscrewed manually by a user onto/from a container, a vessel, a recipient or a similar article, wherein this cover or cap allows its firm and stable screwing on the container, as well as its easy unscrewing, and also a comfortable and convenient transportability of the container on which the cover or cap itself is screwed.

The invention claimed is:

1. A cover or cap configured to be manually screwed/unscrewed by a user onto/from one of a container, a recipient, a vessel, and an article, the cover or cap comprising:

a body, made by molding a plastic material, said body, made of plastic material, having, along a respective upper surface or face, a manual grip or handle configured to receive and be gripped by fingers and a palm of a hand of the user, when screwing/unscrewing the cover or cap onto/from the container, said manual grip or handle comprising a grip recess which extends deep into the body of the cover or cap and is sized to receive and house all or some of an index finger, a middle finger, a ring finger, and a little finger, arranged side by side, of the fingers of the hand of the user, wherein said grip recess has an opening on the upper surface or face of the body of the cover or cap, and is formed between an upper wall, substantially flat, extending along said upper face or surface of the body of the cover or cap, and a lower wall extending along a lower face of the body of the cover or cap, wherein said upper wall is configured to be gripped by the fingers and by the palm of the hand of the user, with the index finger, the middle finger, the ring finger and little finger which are received, all or some, arranged side by side, in said grip recess, and with the thumb finger closing outside the grip recess on said body of the cover or cap, wherein said grip recess provides said manual grip or handle that is configured to be gripped by the fingers and by the palm of the hand of the same user, when screwing/unscrewing the cover or cap onto/from the container, wherein said lower wall has a concave shape, and wherein said body comprises a first plastic part that defines said substantially flat upper wall, and a separate second plastic part that has a lowered dome shape and defines the lower wall of the body of the cover or cap, both of the first plastic part and the second plastic part being a plastic material, the first plastic part and the second plastic part being snap coupled together to form said body, the first plastic part including a middle collar and an inner collar defining a first plastic part recess, the second plastic part including an upper edge snap coupled into the first plastic part recess.

2. The cover or cap according to claim 1, wherein said body, of plastic material, is propylene.

3. The cover or cap according to claim 1, wherein said body has a diameter between 100 and 120 mm and a height between 20 and 40 mm.

4. A cover or cap configured to be manually screwed/unscrewed by a user onto/from one of a container, a recipient, a vessel, and an article, the cover or cap comprising:

a body, made by molding a plastic material, said body, made of plastic material, having, along a respective upper surface or face, a manual grip or handle configured to receive and be gripped by fingers and a palm of a hand of the user, when screwing/unscrewing the cover or cap onto/from the container, said manual grip or handle comprising a bar which extends transversely along said upper surface or face of the body of the cover or cap and is sized to be gripped and embraced by the fingers and from the palm of the hand of the user, with all or some of an index finger, a middle finger, a ring finger and a little finger of the fingers engaging and embracing, arranged side by side, said bar, and with a thumb closing on said body of the cover or cap, wherein said bar provides said manual grip or handle that is configured to being gripped by the fingers and by the palm of the hand of the user, when screwing/unscrewing the cover or cap onto/from the container; and wherein said body comprises a first plastic part that defines said bar and a separate second plastic part that defines a lower wall of the body of the cover or cap, both of the first plastic part and the second plastic part being a plastic material, the first plastic part and the second plastic part being snap coupled together to form said body, the first plastic part including a middle collar and an inner collar defining a first plastic part recess, the second plastic part including an upper edge snap coupled into the first plastic part recess.

5. The cover or cap according to claim 4, further comprising a lower wall, slightly rounded outwards, which extends along a lower face of the cover or cap.

6. The cover or cap according to claim 4, wherein said body, of plastic material, is propylene.

7. The cover or cap according to claim 4, wherein said body has a diameter between 160 and 200 mm and a height between 30 and 45 mm.

8. A container comprising the cover or cap according to claim 1, wherein the container is configured to be screwed/unscrewed onto/from a mouth of a containment body of the container.

9. The container according to claim 8, wherein the respective containment body, on which the cover or cap is screwable/unscrewable, is a glass containment body.

10. The cover or cap according to claim 1, wherein the first plastic part further includes an outer wall, the middle collar being disposed between the outer wall and the inner collar.

* * * * *